US011084182B1

(12) United States Patent
Vankleef

(10) Patent No.: US 11,084,182 B1
(45) Date of Patent: Aug. 10, 2021

(54) COOPERAGE LAYOUT FOR BARREL PRODUCTION PROCESS

(71) Applicant: Bohnert Equipment Company, Inc., Louisville, KY (US)

(72) Inventor: Ericus Vankleef, Louisville, KY (US)

( * ) Notice: Subject to any disclaimer, the term of this patent is extended or adjusted under 35 U.S.C. 154(b) by 137 days.

(21) Appl. No.: 16/283,174

(22) Filed: Feb. 22, 2019

Related U.S. Application Data

(60) Provisional application No. 62/638,558, filed on Mar. 5, 2018.

(51) Int. Cl.
*B27H 5/10* (2006.01)
*B27H 5/12* (2006.01)

(52) U.S. Cl.
CPC ..... *B27H 5/10* (2013.01); *B27H 5/12* (2013.01)

(58) Field of Classification Search
CPC ... B27H 5/00; B27H 5/02; B27H 5/04; B27H 5/08; B27H 5/10
See application file for complete search history.

(56) References Cited

PUBLICATIONS

Robinson Stave Mill and East Bernstadt Cooperage, Making a bourbon barrel, Dec. 19, 2017, https://www.facebook.com/robinsonstavemill/videos/737427176443022/ (Year: 2017).*
Midwestsupplies, Midwest Supplies tours the Barrel Mill, May 1, 2011, https://www.youtube.com/watch?v=AKAInMkheHw (Year: 2011).*
Jordan Vineyard & Winery, How Wine Barrels are Made | Cooperage Oak Barrel Making & Barrel Toasting Demonstration, Apr. 12, 2011, https://www.youtube.com/watch?v=aCrkmyQtQIM&feature=youtu.be (Year: 2011).*
WinepagesTV, how a wine barrel is made, Jun. 12, 2015, https://www.youtube.com/watch?v=BReofCcAx-Y (Year: 2015).*
Kawasaki Robotics UK, Robots handling barrels at Speyside Cooperage, Aug. 8, 2013, https://www.youtube.com/watch?v=oDtx9X1acOY (Year: 2013).*

* cited by examiner

*Primary Examiner* — Matthew Katcoff

(57) ABSTRACT

A cooperage layout for a barrel production process enhances efficiency and/or reduces costs, space requirements and/or noise by positioning barrel raising, windlass, roll out, and/or bilge hoop puller stations within a cooperage and/or through the use of a power and free conveyor to convey temporary truss hoops between a truss hoop puller station and the barrel raising and windlass stations.

19 Claims, 2 Drawing Sheets

COOPERAGE LAYOUT FOR BARREL PRODUCTION PROCESS

BACKGROUND

Barrel production in a cooperage includes numerous steps, stations and machinery to produce a barrel, as well as various material handling steps and machinery to convey barrels, barrel components such as staves, hoops and heads, and temporary components such as hoops and trusses throughout a cooperage. The layout or arrangement of stations and machinery, as well as the selection and placement of material handling machinery to convey material between the stations, can have a significant impact on the cost and efficiency of a barrel production process. However, many conventional cooperage designs for barrel production have been found to be inefficiently organized, loud, wasteful, and expensive.

SUMMARY

The invention addresses these and other problems associated with the art by providing a cooperage layout for a barrel production process that enhances efficiency and/or reduces costs, space requirements and/or noise by positioning barrel raising, windlass, roll out, and/or bilge hoop puller stations within a cooperage and/or through the use of a power and free conveyor to convey temporary truss hoops between a truss hoop puller station and the barrel raising and windlass stations.

Therefore, consistent with one aspect of the invention, a method of constructing wooden barrels may include, at a barrel raising station disposed at a first location in a cooperage, raising a barrel using a temporary raising ring and a first temporary truss hoop, after raising the barrel, conveying the barrel to a steam station disposed at a second location in the cooperage to steam the barrel, after steaming the barrel, conveying the barrel to a windlass station disposed at a third location in the cooperage to draw staves of the barrel together and using a second temporary truss hoop, including removing the temporary raising ring from the barrel, where the third location of the windlass station is adjacent the first location of the barrel raising station in the cooperage, returning the temporary raising ring to the barrel raising station without use of a conveyor or material handling system, after drawing the staves of the barrel together in the windlass station and at a roll out station disposed at a fourth location in the cooperage, rolling out the barrel using a pair of temporary bilge hoops placed on a pair of feed tracks, after rolling out the barrel, performing a plurality of operations at a plurality of stations in the cooperage while the barrel has the pair of temporary bilge hoops and the first and second temporary truss hoops installed thereon, after performing the plurality of operations and at a truss hoop puller station disposed at a fifth location in the cooperage, removing the first and second temporary truss hoops from the barrel, moving the first and second temporary truss hoops to a power and free conveyor extending between the first, second and fifth locations, with the power and free conveyor, conveying each of the first and second temporary truss hoops to one of the barrel raising station and the windlass station, after removing the first and second temporary truss hoops from the barrel, conveying the barrel to a bilge hoop puller station disposed at a sixth location in the cooperage to remove the pair of temporary bilge hoops from the barrel, where the sixth location of the bilge hoop puller station is adjacent the fourth location of the roll out station in the cooperage, and moving the pair of temporary bilge hoops from the bilge hoop puller station to the pair of feed tracks of the roll out station without use of a conveyor.

Consistent with another aspect of the invention, a method of constructing wooden barrels may include at a barrel raising station disposed at a first location in a cooperage, raising a barrel using a temporary raising ring, after raising the barrel, conveying the barrel to a steam station disposed at a second location in the cooperage to steam the barrel, after steaming the barrel, conveying the barrel to a windlass station disposed at a third location in the cooperage to draw staves of the barrel together, including removing the temporary raising ring from the barrel, where the third location of the windlass station is adjacent the first location of the barrel raising station in the cooperage, and returning the temporary raising ring to the barrel raising station without use of a conveyor or material handling system.

Some embodiments may also include accumulating a plurality of temporary raising rings in the windlass station. Also, in some embodiments, returning the temporary raising ring to the barrel raising station is performed by an operator of the barrel raising station. Further, in some embodiments, the first location of the barrel raising station and the third location of the windlass station are adjacent the second location of the steam station such that the barrel raising station and windlass station run alongside the steam station. In some embodiments, the barrel raising station and the windlass station are less than about thirty feet from one another.

Consistent with another aspect of the invention, a cooperage may include a barrel raising station disposed at a first location in the cooperage and configured to use temporary raising rings, a steam station disposed at a second location in the cooperage and configured to receive barrels from the barrel raising station, and a windlass station disposed at a third location in the cooperage to receive barrels from the steam station, where the windlass station is configured to remove temporary raising rings from the barrels, and where the third location of the windlass station is adjacent the first location of the barrel raising station.

Consistent with another aspect of the invention, a method of constructing wooden barrels may include, at a roll out station disposed at a first location in a cooperage, rolling out a barrel using a pair of temporary bilge hoops received on a pair of feed tracks, after rolling out the barrel, performing a plurality of operations at a plurality of stations in the cooperage while the barrel has the pair of temporary bilge hoops installed thereon, after performing the plurality of operations, conveying the barrel to a bilge hoop puller station disposed at a second location in the cooperage to remove the pair of temporary bilge hoops from the barrel, where the second location of the bilge hoop puller station is adjacent the first location of the roll out station in the cooperage, and moving the pair of temporary bilge hoops from the bilge hoop puller station to the pair of feed tracks of the roll out station without use of a conveyor.

In addition, in some embodiments, moving the pair of temporary bilge hoops is performed by one or more industrial robots. In some embodiments, the plurality of stations include two or more of a char station, a crozier station, a truss hoop puller station, or a head up station. In addition, in some embodiments, the roll out station and the bilge hoop puller stations run alongside one another in the cooperage.

Consistent with another aspect of the invention, a cooperage may include a roll out station disposed at a first location in the cooperage and including a pair of feed tracks configured to receive pairs of temporary bilge hoops, a plurality of stations downstream of the roll out station in the cooperage and configured to perform a plurality of operations on barrels received from the roll out station and having temporary bilge hoops installed thereon, a bilge hoop puller station disposed at a second location in the cooperage to remove the pairs of temporary bilge hoops from barrels, where the second location of the bilge hoop puller station is adjacent the first location of the roll out station in the cooperage, and one or more industrial robots configured to move pairs of temporary bilge hoops from the bilge hoop puller station to the pair of feed tracks of the roll out station.

Consistent with another aspect of the invention, a method of constructing wooden barrels may include, at a barrel raising station disposed at a first location in a cooperage, raising a barrel using a first temporary truss hoop, after raising the barrel, conveying the barrel to a windlass station disposed at a second location in the cooperage using a second temporary truss hoop, thereafter performing a plurality of operations at a plurality of stations in the cooperage while the barrel has the first and second temporary truss hoops installed thereon, thereafter at a truss hoop puller station disposed at a third location in the cooperage, removing the first and second temporary truss hoops from the barrel, moving the first and second temporary truss hoops to a power and free conveyor extending between the first, second and third locations, and with the power and free conveyor, conveying each of the first and second temporary truss hoops to one of the barrel raising station and the windlass station.

Moreover, in some embodiments, the power and free conveyor includes a single track proximate the truss hoop puller station, a first switch downstream of the truss hoop puller station and upstream of each of the barrel raising station and the windlass station, a first split track extending from the first switch to convey temporary truss hoops to the barrel raising station, a second split track extending from the first switch to convey temporary truss hoops to the windlass station, and a second switch downstream of the barrel raising station and the windlass station and upstream of the truss hoop puller station.

Some embodiments may also include, with the first split track, conveying temporary truss hoops to a load bar to accumulate temporary truss hoops on the load bar, and lowering the load bar to transfer temporary truss hoops to a cart for use in the barrel raising station. Some embodiments may further include moving temporary truss hoops from the second split track to the windlass station with one or more industrial robots to present temporary truss hoops for use by an operator of the windlass station. In some embodiments, moving the first and second temporary truss hoops to the power and free conveyor is performed by one or more industrial robots. In addition, in some embodiments, the power and free conveyor encircles at least a steam station, a bilge hoop puller station, a roll out station, a crozier station, a char station and the truss hoop puller station in the cooperage.

Consistent with another aspect of the invention, a cooperage may include a barrel raising station disposed at a first location in the cooperage and configured to use temporary truss hoops, a windlass station disposed at a second location in the cooperage and configured to use temporary truss hoops, a plurality of stations downstream of the windlass station in the cooperage and configured to perform a plurality of operations on barrels received from the windlass station and having pairs of temporary truss hoops installed thereon, a truss hoop puller station disposed at a third location in the cooperage to remove the pairs of temporary truss hoops from the barrels, a power and free conveyor extending between the first, second and third locations and configured to convey temporary truss hoops from the truss hoop puller station to the barrel raising station and the windlass station, and one or more industrial robots positioned proximate the truss hoop puller station and configured to move temporary bilge hoops from the bilge hoop puller station to the power and free conveyor.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Embodiments consistent with the invention are generally directed to various aspects of a cooperage layout for generally reducing costs, reducing waste, increasing safety, improving ergonomics and/or improving workplace conditions associated with a barrel production process. A cooperage layout generally refers to the arrangement and interaction of production machinery and material handling systems for a barrel cooperage.

Barrels that may be produced using the various processes described herein may include, for example, various types of wooden barrels used for aging and/or storing beverages such as whiskey, bourbon, wine, etc. However, it will be appreciated that the herein-described processes may be used in the production of other types of wooden barrels, so the invention is not limited to any particular use, size or type of wooden barrel.

Figure 1:
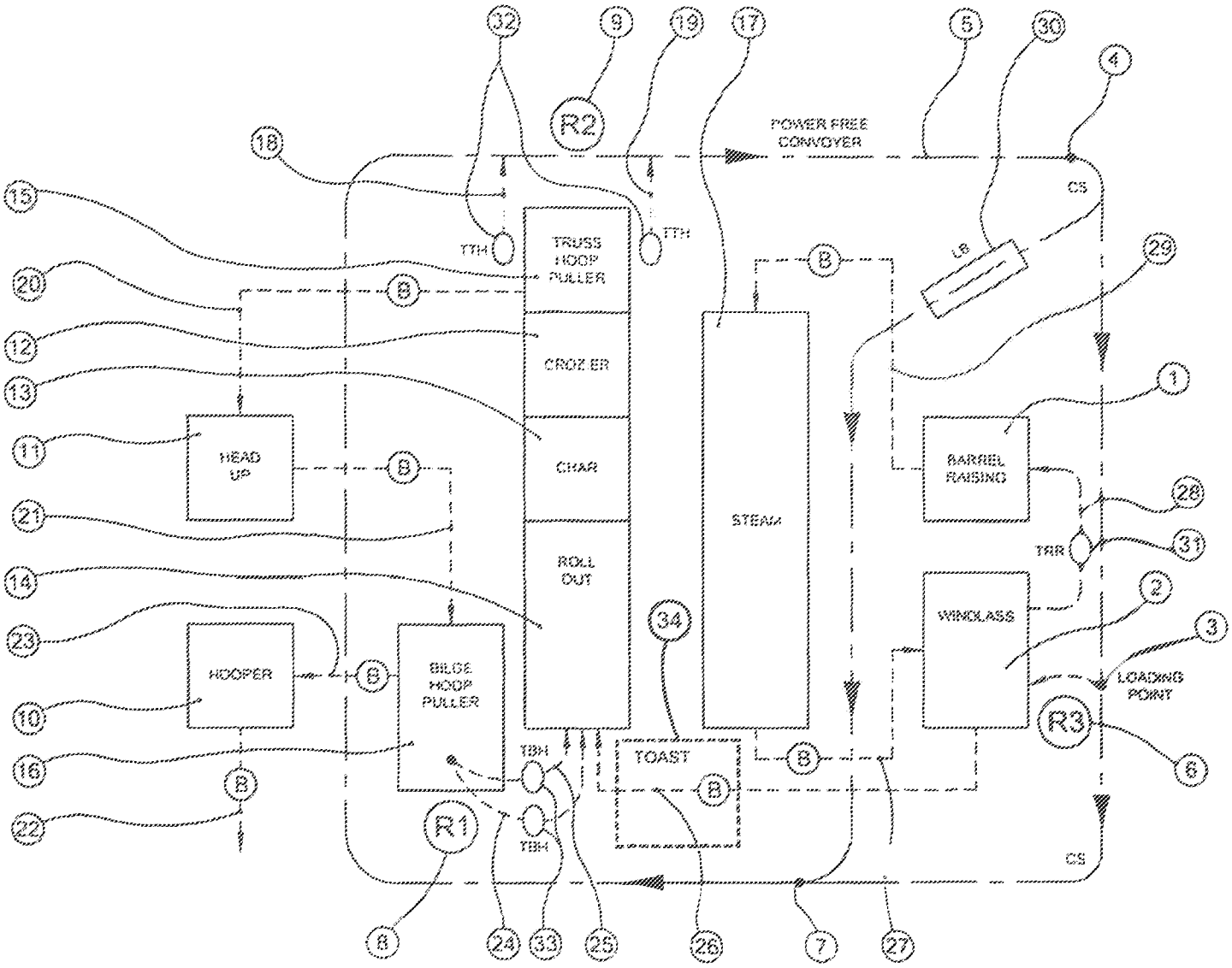
FIG. 1 is a functional top plan view of a cooperage layout for a barrel production process consistent with some embodiments of the invention.

FIG. 1, for example, illustrates a functional top plan view of a cooperage layout for a portion of a barrel production process consistent with some aspects of the invention. It will be appreciated that the stations and operations illustrated in FIG. 1 represent only a portion of a barrel production process, and that other operations may be performed prior to and subsequent to the various operations illustrated in FIG. 1. For example, prior to the operations represented in FIG. 1, operations such as sawing, drying, milling and/or jointing barrel staves and barrel heads may be performed, as may operations such as forming the metal hoops or bands. Likewise, subsequent to the operations represented in FIG. 1, operations such as drilling for bungs, leak testing, marking or stenciling, coating, sealing, specialized packaging, etc. may be performed.

Figure 2A:
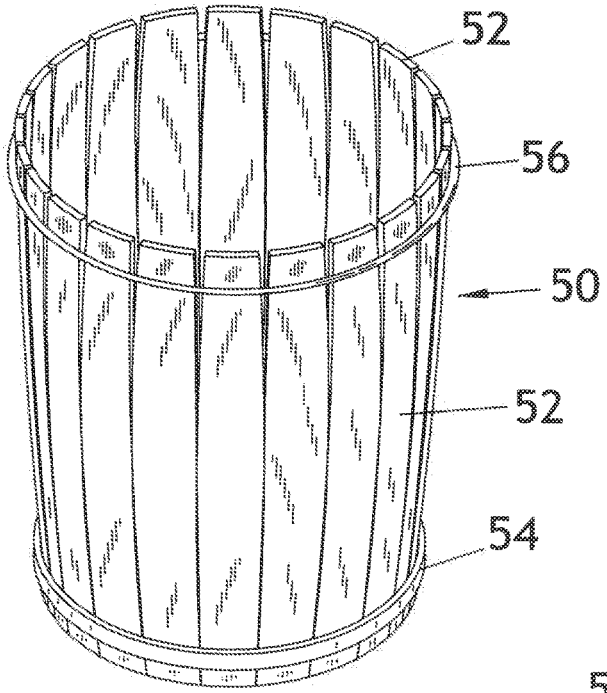
FIGS. 2A-2C illustrate barrels at three stages of the barrel production process illustrated in FIG. 1.

From the perspective of a barrel (various barrels flowing through the process are represented by circles labeled "B"), the operations represented in FIG. 1 begin in a barrel raising station 1, where staves are combined in a circular arrangement forming the basis of what will eventually become a barrel. A barrel raising operation generally utilizes one Temporary Truss Hoop (TTH) 32 as a template for the circular arrangement of the staves, along with one Temporary Raising Ring (TRR) 31 to hold the staves in the circular arrangement. With reference to FIG. 2A, for example, a barrel 50 subsequent to a barrel raising operation may include multiple staves 52 supported by a Temporary Truss Hoop 54 and held together in a circular arrangement by a Temporary Raising Ring 56.

Returning to FIG. 1, as illustrated at 29, the barrel is conveyed from barrel raising station 1 to a steam station 17, where the wooden staves are plasticized to allow the staves to be more easily bent. Thereafter, the barrel (which at this point still includes only wooden staves, one Temporary Truss Hoop at the base and one Temporary Raising Ring at the top) is conveyed to a windlass station 2.

In windlass station 2, the staves of the barrel are formed into a barrel shape, and the windlass operation adds another Temporary Truss Hoop 32 to the opposite end of the barrel to hold the staves in the barrel shape. In addition, during this operation the Temporary Raising Ring 31 is removed from the barrel and is returned to barrel raising station 1, as illustrated at 28. As such, when the barrel leaves the windlass station 2, the barrel includes the wooden staves and two Temporary Truss Hoops 32 securing the opposite ends of the barrel, one installed at the barrel raising station 1 and one installed at the windlass station 2.

Figure 2B:
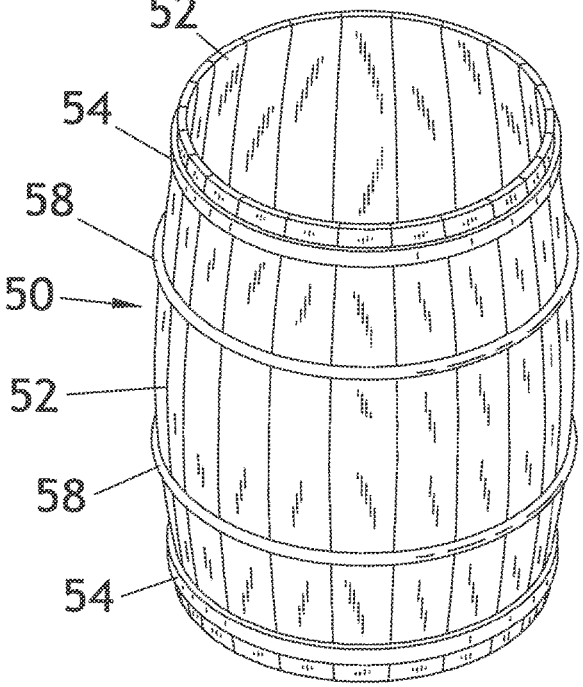

Next, the barrel is conveyed as illustrated at 26 to a roll out station 14, at which point two Temporary Bilge Hoops (TBHs) 33 are installed on the barrel. During the roll out operation both the two Temporary Truss Hoops 32 and the two Temporary Bilge Hoops 33 are tightened onto the barrel and the barrel is rounded into shape. Thus, leaving the roll out station 14, the barrel includes the wooden staves, two Temporary Truss Hoops 32 and two Temporary Bilge Hoops 33. FIG. 2B, for example, illustrates barrel 50 of FIG. 2A, including staves 52, two temporary truss hoops 54 and two temporary bilge hoops 58.

Returning to FIG. 1, alternatively, in some embodiments, a toast station 34 may be positioned between the windlass station 2 and roll out station 14 to perform a toasting operation on the inside of the barrel prior to the roll out operation. Toasting may be used, for example, to release sugars from the wood to impart a desired flavor to liquid aged in the barrel.

Regardless of whether a toasting operation is performed, a barrel exiting the roll out station 14 is supplied to a char station 13 to char or burn the inside of the barrel, again to impart a desired flavor to a liquid that is aged in the barrel. Thereafter, the barrel proceeds to a crozier station 12, where grooves for the heads are cut into the barrel staves, and the ends of the barrel staves are trimmed to length. The barrel then moves to a truss hoop puller station 15 to remove the two Temporary Truss Hoops 32, whereby the barrel exiting the truss hoop puller station 15 includes the wooden staves and two Temporary Bilge Hoops 33.

Thereafter, the barrel is conveyed as illustrated at 20 to a head up station 11, where a head and a permanent head hoop is installed on each end of the barrel, whereby the barrel includes wooden staves, two Temporary Bilge Hoops 33, two installed heads and two permanent head hoops. Next, the barrel is conveyed as illustrated at 21 to a bilge hoop puller station 16, which removes the two Temporary Bilge Hoops 33, whereby the barrel includes wooden staves, two installed heads, and two permanent head hoops.

Figure 2C:
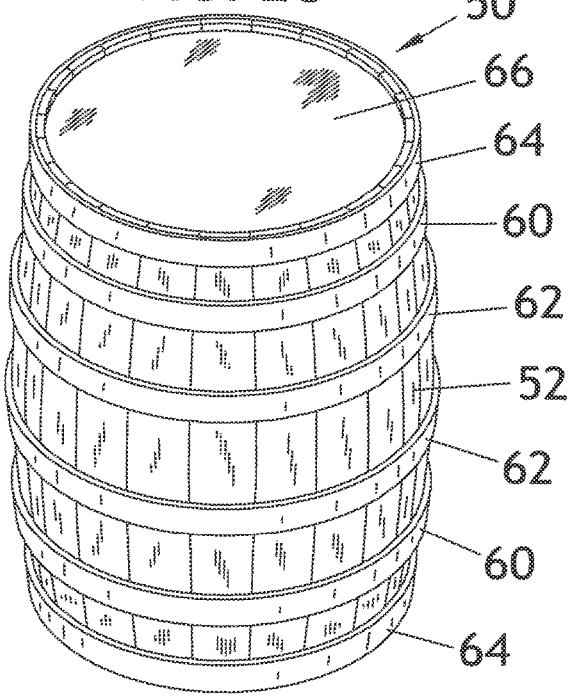

Thereafter, the barrel is conveyed as illustrated as illustrated at 23 to a hoop driver station 10 to have permanent quarter hoops and permanent bilge hoops installed. The barrel at this point is as illustrated in FIG. 2C, where barrel 50 includes staves 52, permanent quarter hoops 60, permanent bilge hoops 62, permanent head hoops 64 and heads 66.

Returning to FIG. 1, the barrel exits hoop driver station 10 and is conveyed as illustrated at 22 to downstream stations to perform additional operations such as drilling for bungs, leak testing, marking or stenciling, coating, sealing, specialized packaging, etc. Production of the barrel is then complete.

With the general layout of stations illustrated in FIG. 1, a number of performance and efficiency improvements may be realized, as discussed in the sections below.

Handling the Temporary Raising Rings

Handling of temporary raising rings 31, which are used in barrel raising station 1 and removed from the barrel at windlass station 2, may be facilitated by locating the barrel raising and windlass station adjacent to one another (e.g., about 20-30 feet or less of separation), and in some instances, both adjacent and alongside steam station 17. By doing so, temporary raising rings 31 may be released from barrels at the windlass station 2, then accumulated by and at the windlass station 2. Operators then have easy and close access to fetch the accumulated temporary raising rings 31 from the windlass station 2, along the path illustrated by dashed line 28. By doing so, the need for material handling or conveying systems to transport temporary raising rings 31 from windlass station 2 to barrel raising station 1 may be omitted, thereby saving the costs associated with the overhead conveying system and auxiliary material handling devices used in traditional cooperages.

Handling of the Temporary Bilge Hoops

As noted above, temporary bilge hoops 33 are used by the roll out station 14 and removed at the bilge hoop puller station 16. Traditional cooperages generally use an overhead conveying system and auxiliary material handling devices to return the temporary bilge hoops to a roll out station; however, in the illustrated embodiment, the bilge hoop puller station 16 is arranged adjacent to roll out station 14 such that an industrial robot 8 (also designated as R1) may be positioned to retrieve temporary bilge hoops 33 and place them directly (as illustrated by dashed lines 24 and 25) into the two feed tracks of the roll out station 14. By doing so, the need for an overhead conveying system and auxiliary material handling devices is eliminated.

Handling of the Temporary Truss Hoops

Temporary truss hoops 32 are used at both the barrel raising station 1 and the windlass station 2, and in the illustrated embodiment, a power and free conveyor 5 is arranged in a loop that passes by or is near truss hoop puller station 15, barrel raising station 1 and windlass station 2.

Temporary truss hoops 32 are pulled (as illustrated by dashed lines 18 and 19) at truss hoop puller station 15 and are placed on power and free conveyor 5 by an industrial robot 9 (also designated as R2). Power and free conveyor 5 then splits at switch 4 into two tracks, with half of the temporary truss hoops provided to each track. Conveyor 5 is arranged in such a way that accumulation of temporary truss hoops 32 occur in front of each of barrel raising station 1 and windlass station 2.

For the track leading to barrel raising station 1, the track leads to a load bar 30 that is arranged to raise and lower vertically to bring temporary truss hoops 32 to operator level working from floor level. Temporary truss hoops 32 accumulate on load bar 30 and then the load bar is called down by an operator to enable the operator to transfer the temporary truss hoops 32 from load bar 30 to move the temporary truss hoops to barrel raising station 1. For example, a wheeled cart may be used to transfer temporary truss hoops from load bar 30 to barrel raising station 1. Thereafter, the load bar 30 may be commanded and returned back up in line with the track, and the accumulation cycle repeats.

For the track leading to windlass station 2, temporary truss hoops 32 may accumulate at an un-loading point 3, and an industrial robot 6 (also designated as R3) may take hoops from power and free conveyor 5 to a presentation station for use by the operator of the windlass station.

The tracks of power and free conveyor 5 also combine at switch 7 downstream of both barrel raising station 1 and windlass station 2.

A number of advantages may be realized from the aforementioned cooperage layout and configuration. For example, the size and complexity of overhead track and/or conveying systems may be reduced\or eliminated. In addition, a reduction of parts count in mechanical systems may be realized, as may a reduction in the required plant floor square footage for production. Overall equipment costs to outfit a cooperage may also be reduced, and cooperage ergonomics may be improved.

Further, in some embodiments, a reduction in the need to engineer and construct additional plant roof loading may occur, and much of the noise associated with overhead conveying tracks used in traditional cooperages may be reduced or eliminated, e.g., due to the elimination of the need for conveyors and/or overhead tracks to move temporary raising rings and/or temporary bilge hoops between various stations in the cooperage.

In some instances, facility sound levels may be reduced down to or below a weighted 85 dB to provide a more pleasant environment for the associates working in the cooperage, and eliminating in some instances mandatory earplug usage. It has been found, for example, that some of the loudest noises generated in a cooperage are produced by the rolling and clanging together of hoops and/or rings being conveyed through overhead conveying tracks, so the elimination of such overhead conveying tracks can, in some instances, substantially reduce noise exposure in a cooperage.

Various additional modifications may be made to the illustrated embodiments consistent with the invention. Therefore, the invention lies in the claims hereinafter appended.

What is claimed is:

1. A wooden barrel construction method, comprising:

at a barrel raising station disposed at a first location in a cooperage, raising a barrel using a temporary raising ring and a first temporary truss hoop;

after raising the barrel, conveying the barrel to a steam station disposed at a second location in the cooperage to steam the barrel;

after steaming the barrel, conveying the barrel to a windlass station disposed at a third location in the cooperage to draw staves of the barrel together and using a second temporary truss hoop, including removing the temporary raising ring from the barrel, wherein the third location of the windlass station is adjacent the first location of the barrel raising station in the cooperage;

returning the temporary raising ring to the barrel raising station;

after drawing the staves of the barrel together in the windlass station and at a roll out station disposed at a fourth location in the cooperage, rolling out the barrel using a pair of temporary bilge hoops placed on a pair of feed tracks;

after rolling out the barrel, performing a plurality of operations at a plurality of stations in the cooperage while the barrel has the pair of temporary bilge hoops and the first and second temporary truss hoops installed thereon;

after performing the plurality of operations and at a truss hoop puller station disposed at a fifth location in the cooperage, removing the first and second temporary truss hoops from the barrel;

moving the first and second temporary truss hoops to a conveyor extending between the first, second and fifth locations and conveying each of the first and second temporary truss hoops to one of the barrel raising station and the windlass station;

after removing the first and second temporary truss hoops from the barrel, conveying the barrel to a bilge hoop puller station disposed at a sixth location in the cooperage to remove the pair of temporary bilge hoops from the barrel, wherein the sixth location of the bilge hoop puller station is adjacent the fourth location of the roll out station in the cooperage; and moving the pair of temporary bilge hoops from the bilge hoop puller station to the pair of feed tracks of the roll out station without use of a conveyor.

2. A wooden barrel construction method, comprising:

at a barrel raising station disposed at a first location in a cooperage, raising a barrel using a temporary raising ring;

after raising the barrel, conveying the barrel to a steam station disposed at a second location in the cooperage to steam the barrel;

after steaming the barrel, conveying the barrel to a windlass station disposed at a third location in the cooperage to draw staves of the barrel together, including removing the temporary raising ring from the barrel, wherein the third location of the windlass station is adjacent the first location of the barrel raising station in the cooperage; and returning the temporary raising ring to the barrel raising station.

3. The method of claim 2, further comprising accumulating a plurality of temporary raising rings in the windlass station.

4. The method of claim 2, wherein returning the temporary raising ring to the barrel raising station is performed by an operator of the barrel raising station.

5. The method of claim 2, wherein the first location of the barrel raising station and the third location of the windlass station are adjacent the second location of the steam station such that the barrel raising station and windlass station run alongside the steam station.

6. The method of claim 2, wherein the barrel raising station and the windlass station are less than about thirty feet from one another.

7. A cooperage, comprising:

a barrel raising station disposed at a first location in the cooperage and configured to use temporary raising rings;

a steam station disposed at a second location in the cooperage and configured to receive barrels from the barrel raising station; and a windlass station disposed at a third location in the cooperage to receive barrels from the steam station, wherein the windlass station is configured to remove temporary raising rings from the barrels and accumulate the removed temporary raising rings at the windless station, and wherein the third location of the windlass station is adjacent the first location of the barrel raising station so that the accumulated temporary raising rings are close to the barrel raising station.

8. A wooden barrel construction method, comprising:

at a roll out station disposed at a first location in a cooperage, rolling out a barrel using a pair of temporary bilge hoops;

after rolling out the barrel, performing a plurality of operations at a plurality of stations in the cooperage while the barrel has the pair of temporary bilge hoops installed thereon;

after performing the plurality of operations, conveying the barrel to a bilge hoop puller station disposed at a second location in the cooperage to remove the pair of temporary bilge hoops from the barrel, wherein the second location of the bilge hoop puller station is adjacent the first location of the roll out station in the cooperage; and moving the pair of temporary bilge hoops from the bilge hoop puller station to the pair of feed tracks of the roll out station.

9. The method of claim 8, wherein moving the pair of temporary bilge hoops is performed by one or more industrial robots.

10. The method of claim 8, wherein the plurality of stations include two or more of a char station, a crozier station, a truss hoop puller station, or a head up station.

11. The method of claim 8, wherein the roll out station and the bilge hoop puller stations run alongside one another in the cooperage.

12. A cooperage, comprising:

a roll out station disposed at a first location in the cooperage and including a pair of feed tracks configured to receive pairs of temporary bilge hoops;

a plurality of stations downstream of the roll out station in the cooperage and configured to perform a plurality of operations on barrels received from the roll out station and having temporary bilge hoops installed thereon;

a bilge hoop puller station disposed at a second location in the cooperage to remove the pairs of temporary bilge hoops from barrels, wherein the second location of the bilge hoop puller station is adjacent the first location of the roll out station in the cooperage; and one or more industrial robots configured to move pairs of temporary bilge hoops from the bilge hoop puller station to the pair of feed tracks of the roll out station.

13. A wooden barrel construction method, comprising:

at a barrel raising station disposed at a first location in a cooperage, raising a barrel using a first temporary truss hoop;

after raising the barrel, conveying the barrel to a windlass station disposed at a second location in the cooperage and adding a second temporary truss hoop;

thereafter performing a plurality of operations at a plurality of stations in the cooperage while the barrel has the first and second temporary truss hoops installed thereon;

thereafter at a truss hoop puller station disposed at a third location in the cooperage, removing the first and second temporary truss hoops from the barrel;

moving the first and second temporary truss hoops to a conveyor extending between the first, second and third locations and conveying each of the first and second temporary truss hoops to one of the barrel raising station and the windlass station.

14. The method of claim 13, wherein the power and free conveyor includes:

a single track proximate the truss hoop puller station;

a first switch downstream of the truss hoop puller station and upstream of each of the barrel raising station and the windlass station;

a first split track extending from the first switch to convey temporary truss hoops to the barrel raising station;

a second split track extending from the first switch to convey temporary truss hoops to the windlass station; and a second switch downstream of the barrel raising station and the windlass station and upstream of the truss hoop puller station.

15. The method of claim 14, further comprising:

with the first split track, conveying temporary truss hoops to a load bar to accumulate temporary truss hoops on the load bar; and lowering the load bar to transfer temporary truss hoops to a cart for use in the barrel raising station.

16. The method of claim 14, further comprising moving temporary truss hoops from the second split track to the windlass station with one or more industrial robots to present temporary truss hoops for use by an operator of the windlass station.

17. The method of claim 13, wherein moving the first and second temporary truss hoops to the conveyor between the first, second and third locations, is performed by one or more industrial robots.

18. The method of claim 13, wherein the power and free conveyor encircles at least a steam station, a bilge hoop puller station, a roll out station, a crozier station, a char station and the truss hoop puller station in the cooperage.

19. A cooperage, comprising:

a barrel raising station disposed at a first location in the cooperage and configured to use temporary truss hoops;

a windlass station disposed at a second location in the cooperage and configured to use temporary truss hoops;

a plurality of stations downstream of the windlass station in the cooperage and configured to perform a plurality of operations on barrels received from the windlass station and having pairs of temporary truss hoops installed thereon;

a truss hoop puller station disposed at a third location in the cooperage to remove the pairs of temporary truss hoops from the barrels;

a conveyor extending between the first, second and third locations and configured to convey temporary truss hoops from the truss hoop puller station to the barrel raising station and the windlass station; and one or more industrial robots positioned proximate the truss hoop puller station and configured to move temporary bilge hoops from the bilge hoop puller station to the power and free conveyor.

* * * * *